US005098324A

United States Patent [19]

Isono et al.

[11] Patent Number: 5,098,324

[45] Date of Patent: Mar. 24, 1992

[54] COMBINATION RAIL SAVER AND KEY HOLDER

[76] Inventors: Dane T. Isono, 98-1580 Hoomahilu St.; Robert H. Asato, 1877 Hoolehua Pl., both of Pearl City, Hi. 96782

[21] Appl. No.: 562,727

[22] Filed: Aug. 2, 1990

[51] Int. Cl.[5] ..... B63B 35/79

[52] U.S. Cl. ..... 441/75; 428/100

[58] Field of Search ..... 114/39.2; 441/75; 428/100; 248/205.2, 206.5

[56] References Cited

U.S. PATENT DOCUMENTS

| | | | |
|---|---|---|---|
| 3,262,479 | 7/1966 | Leguillon | 248/206.5 |
| 3,529,649 | 9/1970 | Bennett | 428/100 |
| 4,610,634 | 9/1986 | Kimura | 441/75 |

*Primary Examiner*—Sherman Basinger
*Assistant Examiner*—Thomas J. Brahan
*Attorney, Agent, or Firm*—Martin E. Hsia

[57] ABSTRACT

A combination rail saver and key holder in which a pocket end of the rail saver is folded over on itself to define a pocket. A first fastener element is attached to the front interior surface and the front exterior surface of the pocket and a complementary second fastener element is attached at an anchor part to the back interior surface of the pocket, leaving a flap part free and projecting outwardly from the opening. A key inserted in the pocket is retained by two independent mechanisms: the fastener element on the front interior surface can be attached to the anchor part of the second fastener element and the flap part can be folded over and engage with the first fastener element on the front exterior surface of the pocket. Alternatively, the pocket can be formed with a separate pocket segment attached to the strap instead of folding over one end of the strap.

6 Claims, 2 Drawing Sheets

COMBINATION RAIL SAVER AND KEY HOLDER

BACKGROUND OF THE INVENTION

This invention relates to a combination rail saver and key holder.

Rail savers are usually attached between the plug of a surfboard and the leash of a surfboard because if the leash were attached directly to the plug, the leash would cause wear on the rear rail (or side) of the surfboard from constant rubbing. The ankle straps for surfboard leashes can be provided with a pocket for a key, but this is uncomfortable because the key is rigid and is pressed against the ankle by the ankle strap. Accordingly, there is a need for a simple way to hold a key securely while a surfboard is being used without the discomfort of placing the key in the ankle strap.

U.S. Pat. No. 4,341,331 to McDougall discloses a wristband construction having a pair of mating strips of hook and loop fastener laid out side by side so that they may swing together in engaged relation.

U.S. Pat. No. 4,610,634 to Kimura discloses a cord for retaining a surfboard having an ankle strap with a small pocket for carrying a key.

U.S. Pat. No. 3,529,649 to Bennett discloses a key retaining receptacle having complementary hook and loop elements surrounding a key.

U.S. Pat. No. 4,417,612 to Couture discloses a pocket key holder including opposing strips of complementary hook and loop fasteners at the openings of pockets for keys.

U.S. Pat. No. 4,441,639 to Craw discloses a container using hook and loop fasteners.

U.S. Pat. No. 4,079,767 to Howard discloses an open mouthed bag having a pair of mating elongated fastener strips secured to the opposite inner surfaces thereof adjacent the opening and a second pair of elongated mating fastener strips secured to the outer surface of the bag adjacent the opening.

U.S. Pat. No. 4,705,086 to O'Neill discloses a wallet for joggers including hook and loop fasteners.

U.S. Pat. No. 3,372,438 to Rinecker discloses a peel resistant tape assembly comprising a hook and loop fastener having an associated tab overlapping an end thereof.

Although some of these references disclose the use of complementary hook and loop fasteners for retaining keys in a pocket, none of these references discloses or suggests the use of an additional means for securely retaining a key in a pocket.

It is therefore an object of this invention to provide a means for surfers to securely retain possession of a key without the attendant discomfort of having a rigid key rubbing against the ankle during surfing.

It is a further object of this invention to provide such a means that is simple and inexpensive to manufacture, but that is still effective in retaining a key securely.

SUMMARY OF THE INVENTION

These and other objects are accomplished by a combination rail saver and key holder, comprising an elongated strap having a transverse pocket fold defining a pocket front between the pocket fold and a pocket end of the strap. The strap is folded over against itself at the pocket fold so that the pocket front overlies a pocket back portion of the strap. The pocket front and the pocket back are attached to each other at their respective longitudinal edges to define a pocket having a front interior surface, a back interior surface, a pocket front exterior surface and an opening. A first fastener element having an interior portion and a latch portion is attached to both sides of the pocket front, with the interior portion attached to the front interior surface adjacent to the opening and the latch portion attached to the pocket front exterior surface adjacent to the opening. A complementary second fastener element having an anchor part and a flap part is attached by the anchor part to the back interior surface adjacent to the opening with the flap part extending outwardly from the opening. The flap can be folded over and engaged with the latch portion of the first fastener element. Independently, the interior portion of the first fastener element can be engaged with the anchor part of the second fastener element. The preferred fastener for this invention is a hook and loop fastener sold under the trademark "Velcro" ®.

With this construction, a key is retained in the pocket by two independent means: (1) by folding over the flap and engaging the complementary latch fastener on the exterior of the pocket, and (2) by engaging the complementary fastener elements lining the front and back interior surfaces of the opening of the pocket.

Of course, the pocket can be formed by attaching a separate segment of material to the strap, instead of forming the pocket by folding over an end of the strap and joining the folded over section to the strap at their respective edges.

DETAILED DESCRIPTION OF THE PREFERRED EMBODIMENT

Figure 1:
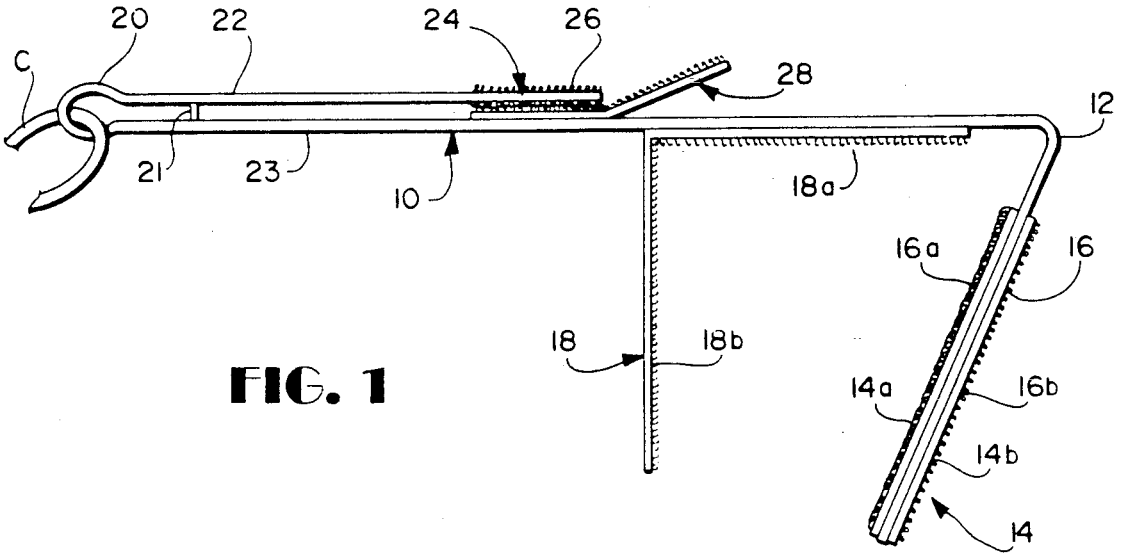
FIG. 1 is a diagrammatic side view of a rail saver in accordance with the preferred embodiment of this invention, with the sides cut away and the vertical dimension exaggerated for clarity.

A conventional rail saver comprises a main body that is usually a strap 10 of woven material. In our invention, one end of the strap 10 is provided with a pocket fold 20 to define a pocket front 22. The pocket front 22 should be at least as long as the length of the longest key to be retained in the pocket. When the pocket front 22 is folded back on the strap 10 along the pocket fold 20, it overlays a pocket back portion 23 of the strap 10. A cord C preferably passes between the pocket front 22 and the pocket back 23 adjacent to the pocket fold 20, and the pocket front 22 and the pocket back 23 are sewn to each other along their longitudinal edges and transversely at a join line 21, thus securing the cord C in the pocket fold 20.

The opposite end of the strap 10 is transversely folded at a plug fold 12 to define a plug flap 14 at one end of the strap 10. The plug flap 14 is then conventionally covered on both sides preferably by a loop element 16. An elongated strip 18 of the complementary hook material having a strap portion 18*a* foldably attached to an engaging portion 18b along a hook fold 19 is then attached only at the strap portion 18a to the strap 10 in such a position that when the plug flap 14 is folded back on the strap 10 along the plug fold 12, the loop element 16a engages with the strap portion 18a of the complementary hook element 18 and when the engaging portion 18b is folded back on the hook element 18 along the hook line 19, the engaging portion 18b engages with the second portion of the complementary loop element 16b. This portion of the rail saver is conventionally used for attachment to the plug of the surfboard by a plug cord, which is conventionally inserted between the plug flap 14 and the hook element 18 near the plug fold 12.

Figure 2:
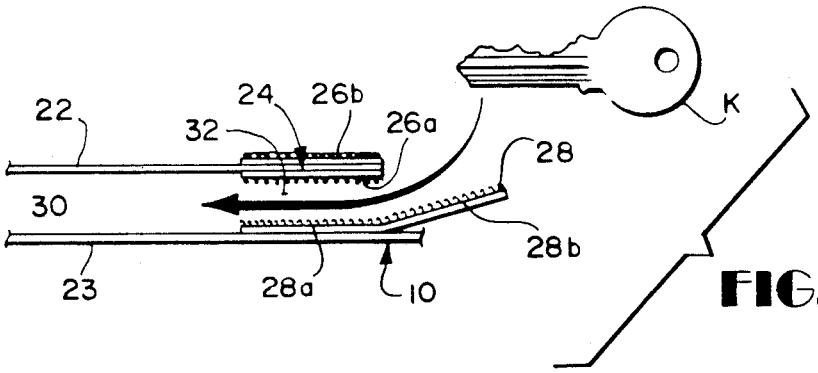
FIG. 2 is an exploded side view of the pocket of FIG. 1.

Referring to FIG. 2, shown is an exploded view of the pocket front 22 and the pocket back 23, which normally are sewn together at their respective longitudinal edges and at the join line 21. Both sides of the tip 24 of the pocket front 22 are covered by a first fastener element 26 (preferably a loop element), with an interior portion 26a inside the pocket and a latch portion 26b outside the pocket, although two separate fastener elements could be used. A strip of a second fastener element 28 complementary to the first fastener element 26 (preferably a hook element) having an anchor part 28a and a flap part 28b then is attached only at the anchor part 28a to the pocket back 23 so that the interior portion 26a of the first fastener element can be engaged with the anchor part 28a and so that the flap part 28b can be folded over to engage with the latch portion of the fastener element 26b (again, two separate fastener elements could be used). The longitudinal edges of the pocket front 22 are preferably sewn to the longitudinal edges of the pocket back 23 so that the pocket front 22, the pocket back 23 and the join line 21 define a pocket 30. The opening 32 of the pocket is thus lined on the inside by complementary fastener elements 26a and 28a and the flap part of fastener element 28b can be folded over to engage with the latch portion of the fastener element 26b.

As can be seen from the preceding description, a key K that is inserted in the pocket 30 will be retained by two independent mechanisms: first, the flap part of the complementary fastener element 28b can be folded over onto the latch portion of the fastener element 26b. If the fastener elements 26b and 28b become unfastened, the key is still retained in the pocket 30 by the engagement of complementary fasteners 26a and 28a on both sides of the opening 32 of the pocket 30.

Figure 3:
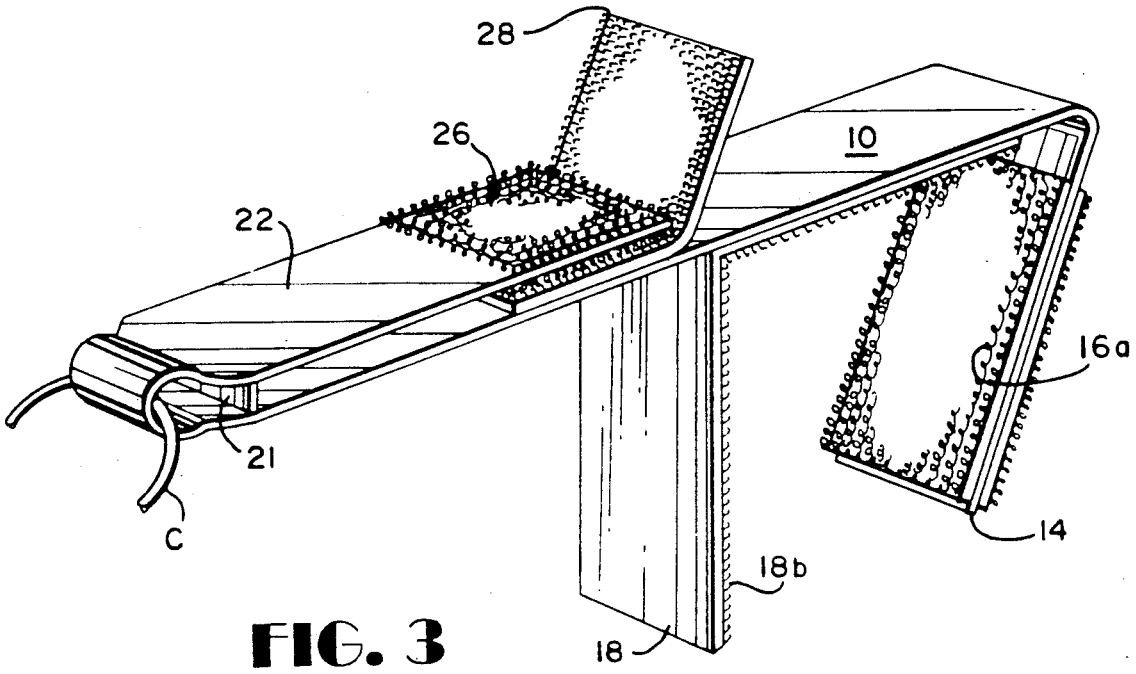
FIG. 3 is a perspective view of the embodiment of FIG. 1.

Referring to FIG. 3, shown is a perspective view of the embodiment of FIGS. 1 and 2.

Figure 4:
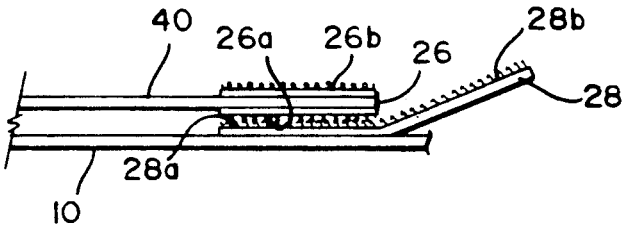
FIG. 4 is an exploded side view of an alternative embodiment in which the pocket is formed by a separate pocket segment attached to the strap, instead of by folding over an end of the strap and joining the folded over section to the strap at their respective edges.

Referring to FIG. 4, shown is an exploded view similar to FIG. 2, except that it shows a separate pocket segment 40 attached to the strap 10 to form a pocket, instead of folding over one end of the strap as shown previously. The structure and attachment of the first fastener element 26 and the second fastener element 28 are the same as shown in FIG. 2.

Although the invention has been described in relation to a particular preferred embodiment, it will be appreciated by those skilled in the art that many modifications and alterations can be made without departing from the spirit and scope of the invention. For example, the hook and loop elements can be interchanged, or other fasteners can be used, such as snaps. Accordingly, no limitations are to be implied or inferred except as set forth in the appended claims.

We claim:

1. A combination rail saver and key holder, comprising:

an elongated strap having a plug end, a pocket end, opposing longitudinal edges, a transverse pocket fold defining a pocket front between said pocket fold and said pocket end of said strap, said pocket front having a length greater than the length of a key, and said strap being folded over against itself at said pocket fold, whereby said pocket front overlies a pocket back portion of said strap;

wherein said pocket front and said pocket back are attached to each other at their respective longitudinal edges to define a pocket having a front interior surface defined by said pocket front, a back interior surface defined by said pocket back, a pocket front exterior surface defined by a surface of said pocket front opposite said front interior surface, and an opening adjacent to said pocket end;

a first fastener element having an interior portion attached to said front interior surface adjacent to said opening and having a latch portion attached to said pocket front exterior surface adjacent to said opening; and a second fastener element complementary to said first fastener element having an anchor part attached to said back interior surface foldably attached to a flap part extending outwardly from said opening to define a flap;

whereby said interior portion of said first fastener element can be engaged with said anchor part of said second fastener element; and whereby said flap part can be folded over and engaged with said latch portion of said first fastener element.

2. A combination rail saver and key holder, according to claim 1, wherein:

said fastener elements are hook and loop fasteners.

3. A combination rail saver and key holder, according to claim 1, wherein said pocket front is sewn to said pocket back at their respective longitudinal edges.

4. A combination rail saver and key holder, according to claim 1, wherein said anchor part is approximately the same size as said interior portion.

5. A combination rail saver and key holder, according to claim 1, wherein said flap part is approximately the same size as said latch portion.

6. A combination rail saver and key holder, according to claim 1, further comprising:

a plug fold in said strap spaced apart from said plug end defining a plug flap;

a plug loop element covering first and second sides of said plug flap;

an elongated plug hook fastener having a strap portion and an engaging portion foldably attached to each other at a plug fastener folding line, attached to the strap only at the strap portion, whereby the loop element on the first side of said plug flap engages with said strap portion when said strap is folded back on itself on said plug fold and the engaging portion of the plug hook fastener engages with said loop element on the second side when the hook fastener is folded back on itself on the hook fastener folding line.

* * * * *